US006702245B1

(12) United States Patent
Otterman

(10) Patent No.: US 6,702,245 B1
(45) Date of Patent: Mar. 9, 2004

(54) DECK RAIL MOUNTING BRACKET

(76) Inventor: F. Thomas Otterman, 2664 Bass Wood La., Wixom, MI (US) 48393

( * ) Notice: Subject to any disclaimer, the term of this patent is extended or adjusted under 35 U.S.C. 154(b) by 0 days.

(21) Appl. No.: 10/273,504

(22) Filed: Oct. 18, 2002

(51) Int. Cl.[7] ..... A47G 25/12

(52) U.S. Cl. ..... 248/536; 248/214; 248/315; 248/316.1

(58) Field of Search ..... 248/534, 535, 248/536, 314, 315, 316.1, 511, 518, 214, 228.1, 228.8, 529, 226.11, 229.2

(56) References Cited

U.S. PATENT DOCUMENTS 2,756,954 A * 7/1956 Whitlow ..... 248/514
2,813,196 A * 11/1957 Dempsey ..... 362/396
3,487,935 A * 1/1970 Lovitz ..... 210/169
3,559,941 A * 2/1971 Holzman ..... 248/228.8
4,301,767 A * 11/1981 Willinger et al. ..... 119/245
5,117,577 A * 6/1992 Burghoff ..... 43/44.99
5,173,181 A * 12/1992 McFarland ..... 210/169
5,704,577 A * 1/1998 Gordon ..... 248/229.2

* cited by examiner

*Primary Examiner*—Ramon O. Ramirez
*Assistant Examiner*—Jon Szumny

(57) ABSTRACT

A bracket that is adapted to attach to a deck rail and hold an umbrella with a long pole similar to the umbrellas that come in patio sets. The bracket is a piece of material with an opening at one end. Within the opening on the bottom of the piece of material, a ring is placed which is adjustable and adapted to tighten against the umbrella's pole. On the other end of the bracket on its bottom side, two L shaped brackets are placed. These two L shaped brackets are spaced a distance equal to the width of a deck rail. On both L shaped brackets, a slot is placed for a belt. The belt contains a buckle that enables the belt to be tightened. To use the bracket one places the deck rail between the two L shaped brackets and then tightens the belt against the deck rail to hold the bracket in place. Then one places the umbrella through the opening and tightens the adjustable ring against the umbrella's pole to hold the umbrella in place. For additional security, one places a small rubber mat on the deck under the umbrella pole to insure that the pole will not slip.

5 Claims, 5 Drawing Sheets

DECK RAIL MOUNTING BRACKET

FIELD OF THE INVENTION

This invention relates to the field of deck rail mounting brackets and more particularly to the field of deck rail mounting brackets that mount a vertical pole to the deck rail.

BACKGROUND OF INVENTION

The inventor of this invention wanted to move his patio umbrella that fits within his patio set to the edge of the deck so that he and his guests could sit at the edge of the deck and look out over his property. However, the umbrella that came with his patio set, which was a basic umbrella mounted on a long pole, was designed only to fit within the patio deck table. The patio deck table had an opening in the middle through which the patio umbrella was placed and it was further held in place by the legs of the table or by a weighted container. Thus, the inventor could not move the patio deck umbrella to the deck railing without moving the table.

The inventor realized that the bracket necessary for mounting the umbrella on the deck rail must meet several objectives. First this mounting bracket must be light weight and be able to be easily mounted on the deck rail. Further, it must also be easy to remove and not cause any damage to the deck. Another objective would be that the bracket would be inexpensive to manufacture.

SUMMARY OF THE INVENTION

The invention is a bracket that is adapted to attach to a deck rail and hold an umbrella with a long pole similar to the umbrellas that come in patio sets. The bracket is a piece of material with an opening at one end. Within the opening, on the bottom of the piece of material, a ring is placed which is adjustable and adapted to tighten against the umbrella's pole. On the other end of the bracket on its bottom side, two L shaped brackets are placed. These two L shaped brackets are spaced a distance equal to the width of a deck rail. On both L shaped brackets, a slot is placed for a belt. The belt contains a buckle that enables the belt to be tightened. To use the bracket one places the deck rail between the two L shaped brackets and then tightens the belt against the deck rail to hold the bracket in place. Then one places the umbrella through the opening and tightens the adjustable ring against the umbrella's pole to hold the umbrella in place. For additional security, one places a small rubber mat on the deck under the umbrella pole to insure that the pole will not slip.

DETAILED DESCRIPTION OF THE PREFERRED EMBODIMENT

Figure 1:
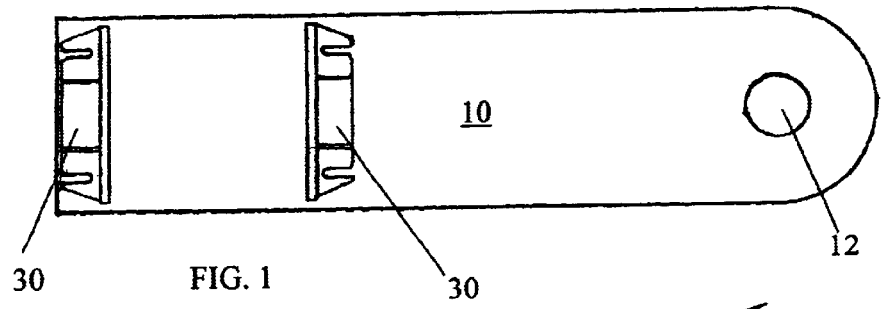
FIG. 1 is a bottom view of the piece of material.
Figure 2:
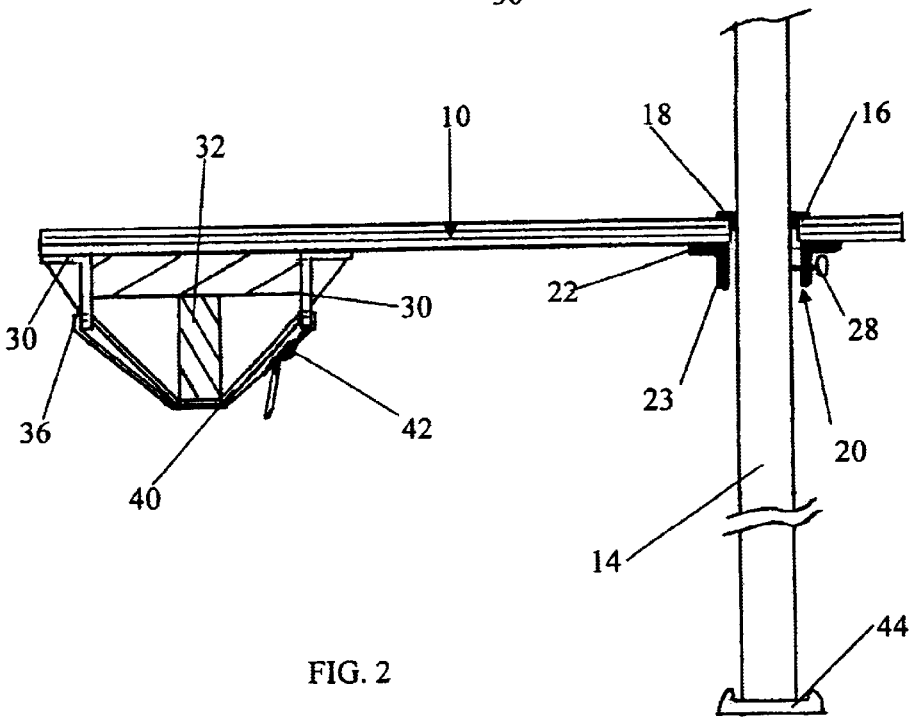
FIG. 2 is a side cut away view of the invention mounted on a deck rail and with the pole in place.

FIG. 1 is a bottom view of the piece of material 10. It shows the invention is a piece of material 10, which is usually wood and is approximately twenty-four inches long and five and one-half inches wide and approximately one inch thick. At one end of the piece of material 10, there is an opening 12, which is larger in diameter than the diameter of the pole 14 of the umbrella. FIG. 2 is the side view of the invention mounted on a deck rail. FIG. 4 is atop view of the invention. On the top of this opening 12 as shown in FIGS. 2 and 4, an adapter ring 18 is mounted. The adapter ring's 18 inner diameter is approximately the same as the outer diameter of the umbrella's pole 14 shown in FIGS. 2 and 3. The outer diameter of this adapter ring 18 is just slightly less than the diameter of the opening 12 in the piece of material 10. At the top of this adapter ring 18 an annular ridge 16 is formed. This annular ridge 16 is adapted such that when the adapter ring 18 is placed within the opening 12 on the piece of material 10, the annular ridge 16 extends over the top of the piece of material 10 and holds the adapter ring in place 16 as shown in FIG. 2.

Figure 5A:
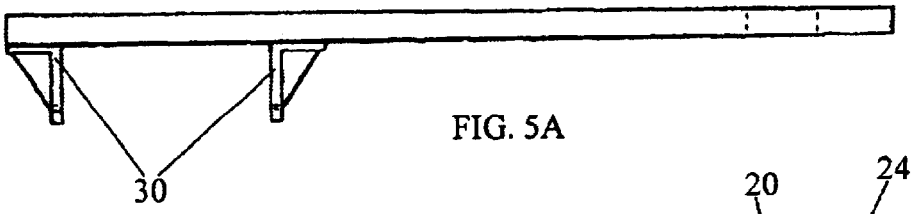
FIG. 5*a* is a side view of the invention.
Figure 5B:
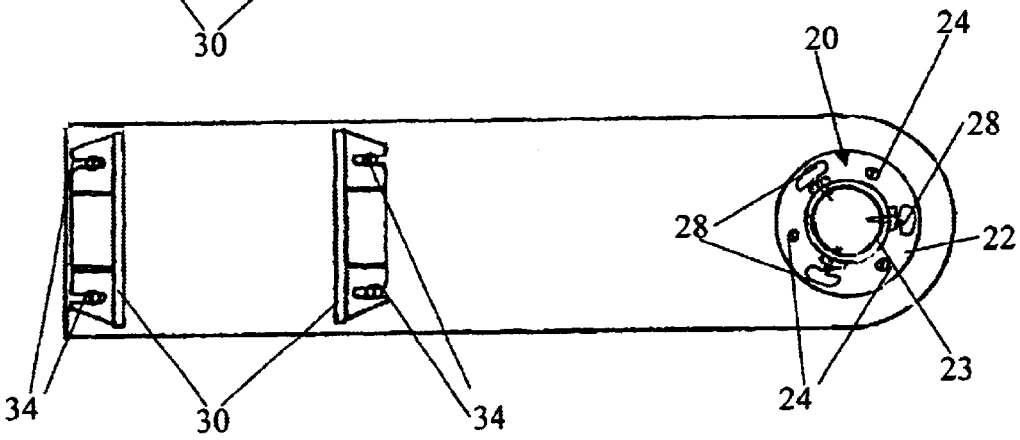
FIG. 5B is a bottom view of the invention.
Figure 7A:
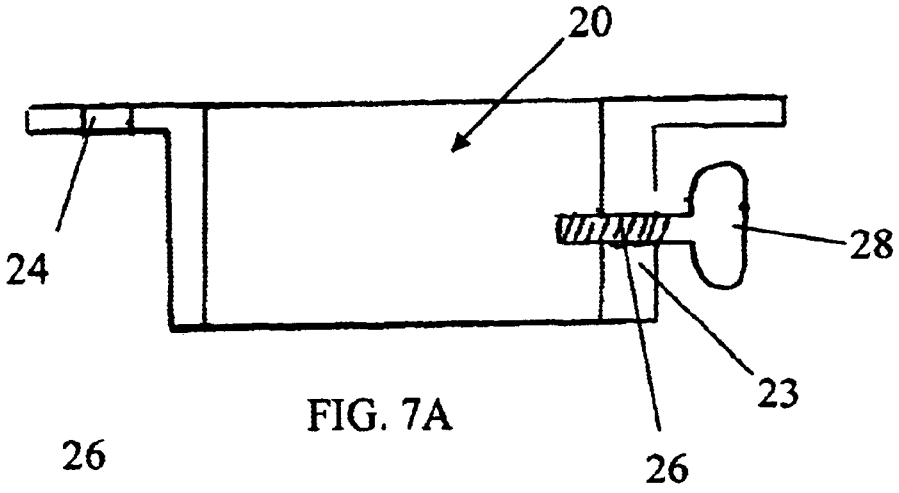
FIG. 7A is a cut away side view of the adjustable ring.
Figure 7B:
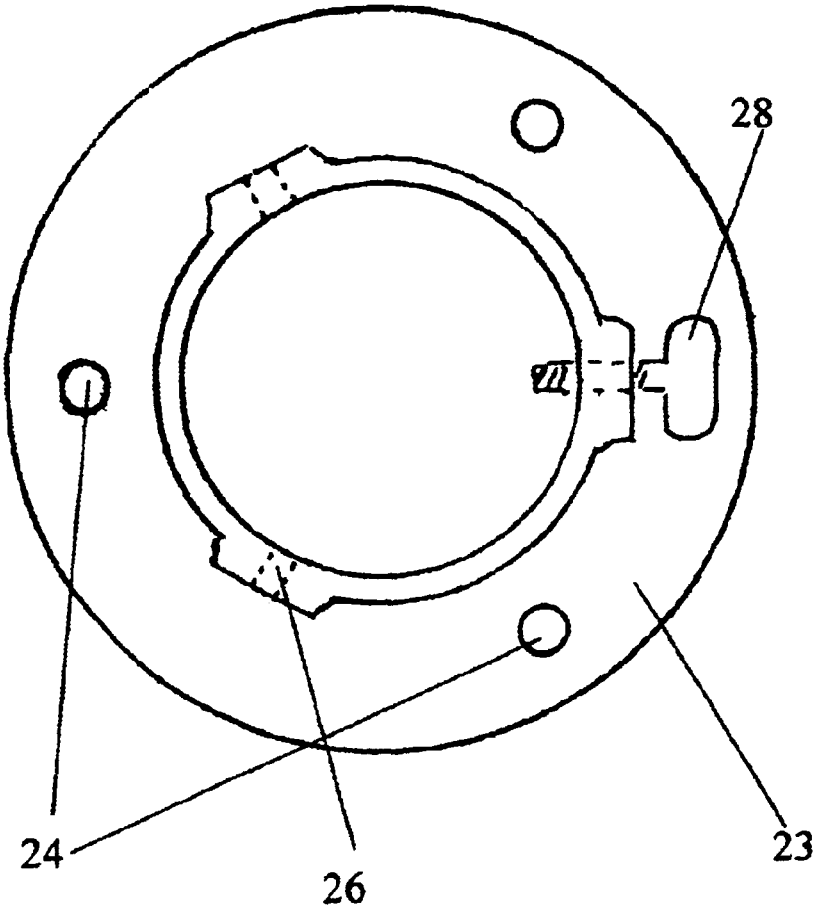
FIG. 7B is a bottom view of the adjustable ring.

FIG. 5B shows the bottom view of the invention. On the bottom of the piece of material 10 at the opening 12, a adjustable ring 20 is placed. The adjustable ring's 20 inner diameter is about the same diameter as the opening's 12 diameter. On the top of the adjustable ring 20 is an annular ridge 22. This annular ridge 22 fits up against the piece of material 10 as shown in FIG. 2. In the annular ridge 22, there are screw openings 24 for screws to attach the adjustable ring 20 to the piece of material as shown in FIG. 5. This adjustable ring 20 can be attached by several other methods known in the art such as glue. The adjustable ring 20 extends downward from the annular ridge 22. Along this, downward extension 23, threaded openings are placed as shown in FIG. 7A. In the preferred embodiment, there are three threaded openings 26 shown in 7B. In the preferred embodiment, these threaded openings 26 are located 120° from each other along the adjustable ring 20 downward extension 23 as shown in FIGS. 2,5 and 7B. Within each of the threaded openings 26, a thumbscrew 28 is placed.

Figure 6:
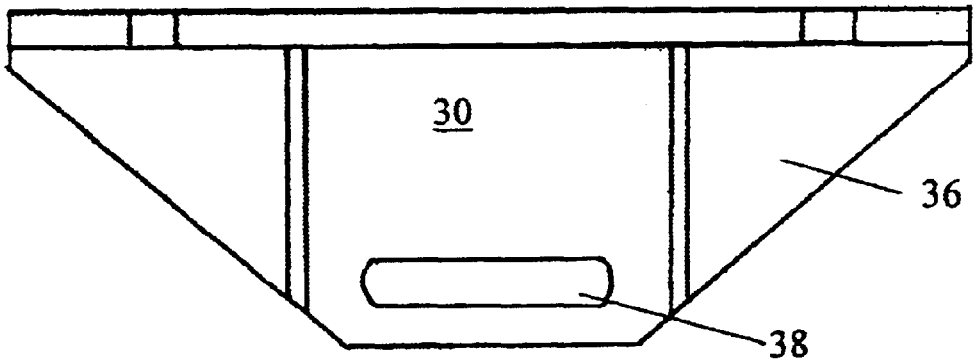
FIG. 6 is an end view of the L-shaped bracket.

At the other end of the piece of material 10, two L-shaped brackets 30 are placed as shown in FIGS. 5A and B. These two L-shaped brackets 30 extend nearly across the width of the piece of material 10. The L-shaped brackets 30 are spaced so that a two by six deck rail 32 can fit between them. The L-shaped brackets 30 can be adjusted for other sizes of deck rails. On a portion of the L-shaped bracket 30 that extends along the bottom of the piece of material 10, screw mounting openings 34 are placed as shown in FIG. 5B. These screw mounting openings 34 are designed to take a screw to screw the L-shaped brackets 30 to the piece of material 10. FIG. 6 show that along the downward extending portion 36 of the L-shaped brackets 30, a slot 38 is located. This slot 38 is located on the L-shaped brackets 30 at a point that is accessible for placing a belt 40 through when the deck rail 32 is placed between the L-shaped brackets 30. Through this slot 38 a belt 40 is run. The belt 40 contains a buckle 42 that allows piece of material 10 to be pulled tight against a deck rail 32 and buckled. The belt 40 is made of a material that will not mark the deck rail 32.

Figure 3:
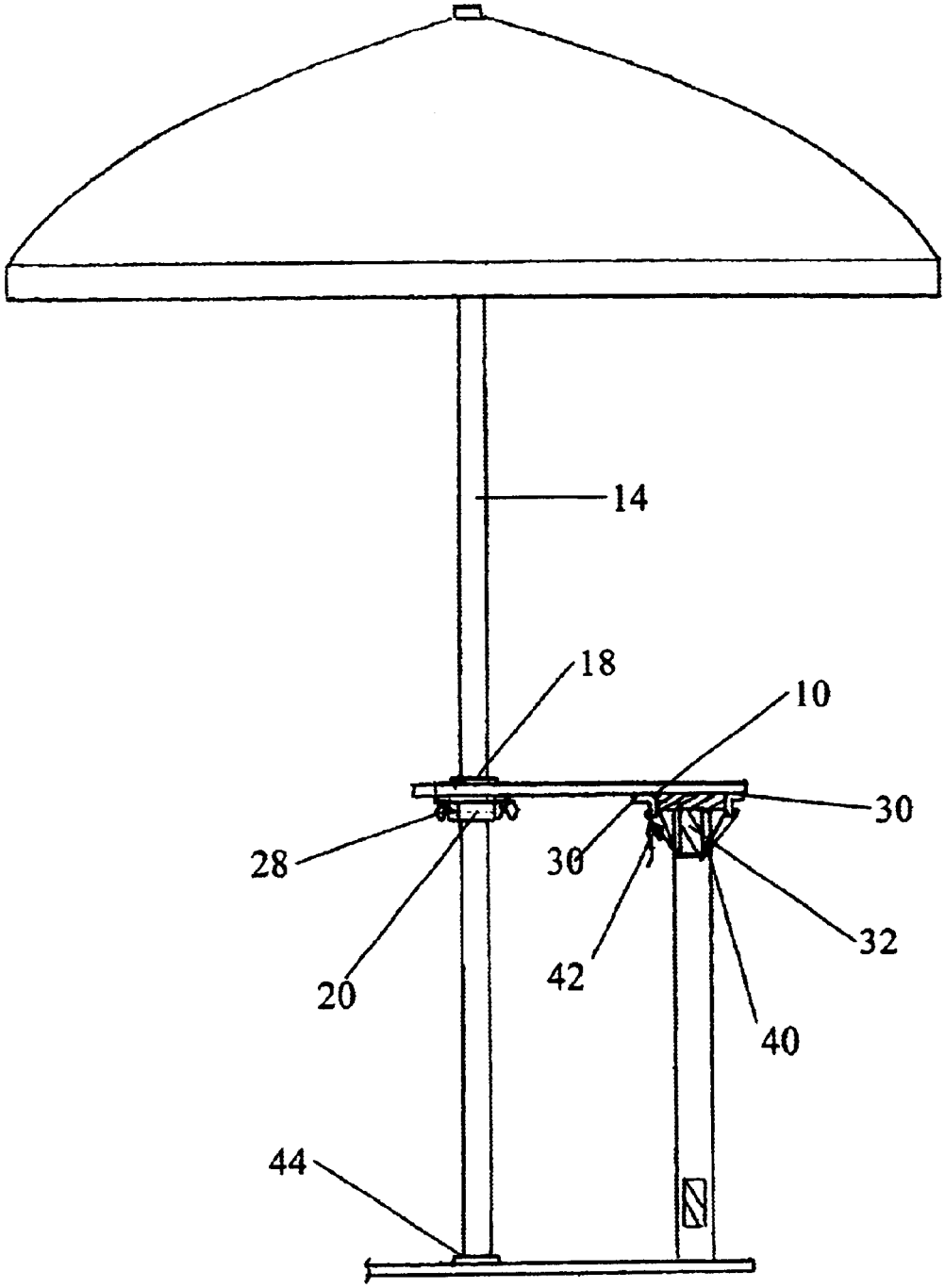
FIG. 3 is a side view of the invention in use mounted on a deck rail and with the pole in place.
Figure 4:
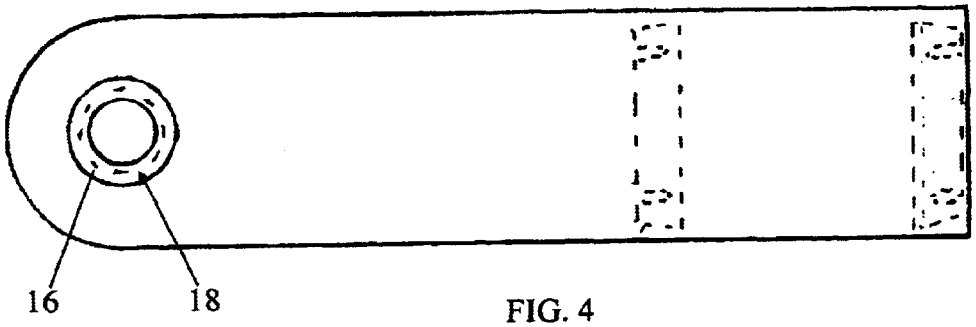
FIG. 4 is a top view of the invention.

FIG. 3 shows the invention in use. To use the invention one first places the piece of material 10 over the deck rail 32 with the deck rail 32 fitting between the two L-shaped brackets 30. Then one runs the belt 40 through the slots 38 in each of the L-shaped brackets 30. The belt 42 is then pulled tight around the deck rail 32 and the piece of material 10, and the belt is buckled with the buckle 42 to hold the invention in place. Then the umbrella's pole 14 is placed through the adapter ring 18, the opening 12 in the piece of material 10, and the adjustable ring 20. A rubber pad 44 is placed on the deck under the umbrella's pole 14 so the pole 14 does not slip as shown in FIG. 3. Then the thumbscrews 28 in the downward extension 23 of the adjustable ring 20 are tightened against the umbrella's pole 14 to hold the umbrella's pole 14 in place. The umbrella now can be opened and used.

Changes and modifications in the specifically described embodiments can be carried out without departing from the scope of the invention that is intended to be limited only by the scope of the appending claims.

What is claimed is:

1. A deck rail mounting bracket that is designed to attach a pole to a deck rail comprising:

a. a piece of material with two ends and two sides; and, b. a means for securely and releasably attaching the piece of material to the deck rail without marking the deck rail at one end of the piece of material comprising;

1. two L shaped brackets placed on one end of the piece of material, and said L shaped brackets are set sufficiently apart so that a deck rail can be placed between them and said L shaped brackets are attached to the piece of material along one section of the L and said L shaped brackets along the other section of the L has a slot; and,
2. a belt that is adapted to fit through the slot in both L shaped brackets; and,
3. a buckle that is adapted to allow the belt to be tightened; and,
4. whereas the piece of material is placed over the deck rail with the deck rail between the two L shaped brackets and then the belt is ran through the slot on the L shaped bracket and the buckle is used to tightened the belt against the deck rail to securely and releasably attach the piece of material to the deck rail; and, c. an opening at the end opposite the end of the piece of material where the deck rail is attached and said opening is adapted to allow the pole to fit through it; and, d. a means to securely and releasably hold the pole upright within said opening; and, e. wherefore, the piece of material is attached to a deck rail by the means for attaching the piece of material to the deck rail and the pole is placed in the opening in the piece of material and the opening is releasably tightened to hold the pole in place.

2. The deck rail mounting bracket that is designed to attach a pole to a deck rail as in claim 1 wherein:

a. the means for securely and releasably holding the pole upright is an adjustable ring that can be tightened against the pole.

3. The deck bracket holding device as in claim 2 wherein:

a. the adjustable ring comprises:

1. a ring that is attached to the piece of material at the opening; and,
2. an annular ridge attached to the ring and; and,
3. a threaded opening in the ridge; and,
4. a thumb screw adapted to be thread into the threaded openings and said thumb screws can be tightened against the pole placed through the ring.

4. A deck bracket holding device as in claim 3 wherein:

a. the adjustable ring is attached to one side of the piece of material at the opening.

5. The deck rail mounting bracket that is designed to attach a pole to a deck rail as in claim 4 further comprising:

a. a separate ring that is attached to the piece of material at the opening on the side opposite the adjustable ring that is adapted to allow the pole to pass through it and hold the pole in place.

* * * * *